United States Patent [19]

Giulianotto

[11] 4,215,626

[45] Aug. 5, 1980

[54] METHOD AND APPARATUS FOR MANUFACTURING ARTICLES MADE OF PAPER FROM A PLURALITY OF PRE-PERFORATED STRIPS

[75] Inventor: Louis Giulianotto, Alfortville, France

[73] Assignee: Agence Nationale de Valorisation de la Recherche (ANVAR), Neuilly-sur-Seine, France

[21] Appl. No.: 882,110

[22] Filed: Feb. 28, 1978

[30] Foreign Application Priority Data

Mar. 3, 1977 [FR] France ..... 77 06207

[51] Int. Cl.[2] ..... B31B 1/10; B31B 1/14

[52] U.S. Cl. ..... 93/94 R; 93/8 W; 93/20; 225/2

[58] Field of Search ..... 93/8 W, 35 R, 94 R, 93/82, 77 CL, 77 R, 20; 270/52; 225/100, 2, 4

[56] References Cited

U.S. PATENT DOCUMENTS

| | | | |
|---|---|---|---|
| 1,816,361 | 7/1931 | Coty et al. | 93/8 W X |
| 2,307,142 | 1/1943 | Lee | 93/8 W |
| 3,433,136 | 3/1969 | Hartbauer et al. | 270/52 X |
| 3,777,958 | 12/1973 | Graham | 225/100 X |
| 3,868,891 | 3/1975 | Parish | 93/8 W |
| 3,897,727 | 8/1975 | Fulk | 270/52 X |

*Primary Examiner*—James F. Coan

*Attorney, Agent, or Firm*—Lewis H. Eslinger

[57] ABSTRACT

A method and apparatus for manufacturing articles made of paper, plastic and the like from n series of strips of such materials is provided wherein n represents the number of strips and is an integer equal to or greater than two. Initially transverse perforations are formed at regular intervals in each of the strips to define in each strip a plurality of elementary sections having the same length L. The strips are then superimposed such that each perforated strip is offset with respect to an adjacent strip in the longitudinal direction by a distance equal to L/n. Thereafter the apparatus which performs the method exerts, successively and independently, on each of the successively superimposed strips a pulling and tearing off action to define the longitudinally offset superimposed perforated strips into separate elementary sections.

9 Claims, 5 Drawing Figures

Fig. 2
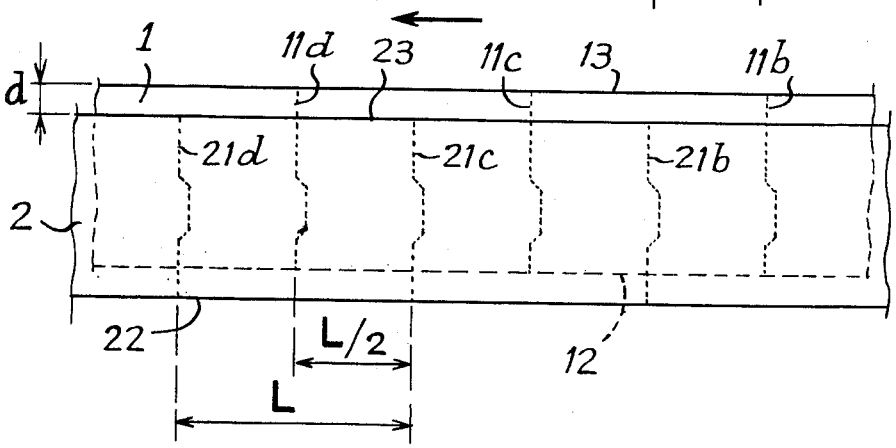
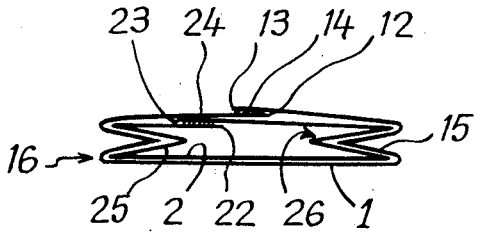
Fig. 3

METHOD AND APPARATUS FOR MANUFACTURING ARTICLES MADE OF PAPER FROM A PLURALITY OF PRE-PERFORATED STRIPS

BACKGROUND OF THE INVENTION

The present invention relates to a method for manufacturing articles made of paper, tissue paper, cellulosic material, plastic or the like, from at least one strip in which transverse perforations have been formed at regular intervals, said perforations being intended to allow the production of elementary sections by tearing off at the perforations and thus effecting a separation.

The present invention also relates to an apparatus for carrying out this method.

SUMMARY OF THE PRIOR ART

Various methods are known according to which a strip of paper or the like is weakened transversely at regular intervals by an outline of perforations. These perforations make it possible, in a subsequent stage of the treatment of the strip, to divide this strip into sections, to constitute sheets, by application of a supplementary traction on the free end of the strip, provoking a tearing off of a section by separating the material at the perforations. The strip may also have undergone various transformations before being divided into sections, for example it may be printed, corrugated, or folded parallel to its longitudinal edges and glued, to form a tube, with or without formation of expanding sides. The pre-perforated strip folded into a tube may, in the same way as before, be divided into tube sections by tearing off at the perforations. This enables bags or sachets in particular to be formed. A pre-perforated strip may of course simply be wound again to form a roll dividable into sections by manual tear-off action, as is the case for example for toilet paper, tissue paper, etc.

The various methods of the prior art have the common drawback of allowing only one strip of paper to be used, when manufacture is effected on the same path. The yields are thus reduced, or the speed of advance movement must be increased to such an extent that the mechanical members must be extremely robust.

It has already been proposed to split a paper strip longitudinally at its centre, in order to obtain two strips which, after having been perforated transversely at the same level, then follow a different, but parallel path. However, such a method does not make it possible to work on individual divided strips which have large transverse dimensions. The parallel, divided strips, which are flat or transformed into tubes, according to whether they are intended to form sheets, rolls or bags, further present the drawback of functioning in parallel so that the perforations made transversely on each of the strips are in line with each other and increase the fragility and risk of untimely tearing along the outlines weakened by the perforations.

SUMMARY OF THE INVENTION

It is precisely an object of the present invention to remedy the above-mentioned drawbacks and to provide a method for producing perforated strips which has an increased yield without the speed of advance movement itself being increased, and which also increases the mechanical strength of the strips during their treatment.

These objects are attained due to a method of the type mentioned at the beginning of this specification in which, according to the invention, at least two strips are used, and the perforated strips are superposed so that each perforated strip is offset with respect to an adjacent strip, in the longitudinal direction, by a distance equal to L/n, where L represents the length of an elementary section of strip and n represents the total number of superposed strips.

It is possible firstly to superpose the various strips, then to perforate them simultaneously and separate the various perforated strips by effecting a shift, in the longitudinal direction, by a distance equal to L/n between two adjacent perforated strips, or to superpose several pre-perforated strips directly with the same spacing between groups of perforations, by effecting the same shift, in the longitudinal direction, by a distance equal to L/n between two adjacent perforated strips.

Due to the invention, it is possible, with the same speed of advance of the strip, to increase the number of articles formed, since a plurality of strips are treated simultaneously. Furthermore, the dimensions of the treating machine are not increased, since the various strips are intended to be superposed on one another. Finally, by the superposition of the various perforated strips with longitudinal shift, the mechanical strength is reinforced, insofar as the superposed strips protect one another mutually at the transverse outlines weakened by perforations, since the various perforations of the different strips are not superposed.

According to a particular feature of the method according to the invention, each strip is also offset, at the beginning, before perforation and longitudinal shifting, with respect to an adjacent strip, in the transverse direction, by a short distance, this short distance preferably being at least equal to about 2 cm, i.e. about the width of a bag "seam."

According to a particular application of the invention, with a view to making bags made of paper or the like, tubes are formed, from the superposed, longitudinally and transversely offset perforated strips, by folding, then gluing on each other the longitudinal edges of each strip, the tubes constituted from the different superposed, offset, perforated strips then being fitted in one another.

The superposed, longitudinally offset, perforated strips, or the tubes fitted in one another made from said strips, may easily be divided into sections by a pulling action exerted momentarily near the free end of the strip or tube which, each time, is more downstream, to provoke a tear-off at the perforations closest to the free end of the tube on which the pulling action is exerted. In this way, a pulling and tear-off action is exerted successively and independently on each of the successively superposed strips or on each of the fitted tubes.

Consequently, sections of tube or strip are easily detached at a rapid rate.

The invention also relates to an apparatus for carrying out the above-mentioned method, which apparatus comprises, for effecting a longitudinal shift of the perforated strips with respect to one another, a number of rollers equal to the number of strips, which rollers are offset in height with respect to one another and are parallel to one another, and a supplementary common roller disposed downstream of said rollers to receive, in superposition, the different strips issuing from the rollers offset in height.

At least one of said rollers offset in height is adjustable in height.

According to an advantageous feature, separating means are disposed downstream of said rollers, which enable a supplementary pull to be exerted in order to effect a tearing off of the sections of strip by successive action on each of the superposed strips or tubes.

More particularly, said separating means comprise a first group of pairs of stop rollers, one of which comprises stop cams or sectors, and a second group of pairs of tear-off rollers, one of which comprises tear-off cams or sectors, the tear-off rollers being disposed downstream of the stop rollers, parallel thereto and at a distance of the order of the length of a section of strip or tube, and the stop and tear-off sectors are in a number equal to the number of strips and regularly distributed over the periphery of the corresponding rollers.

BRIEF DESCRIPTION OF THE DRAWINGS

FIG. 2 is a plan view of a group of superposed, offset strips according to the invention.

FIG. 3 is a view in transverse section of the two strips of FIG. 2 after folding and gluing to form a double tube.

DESCRIPTION OF THE PREFERRED EMBODIMENT

Figure 1:
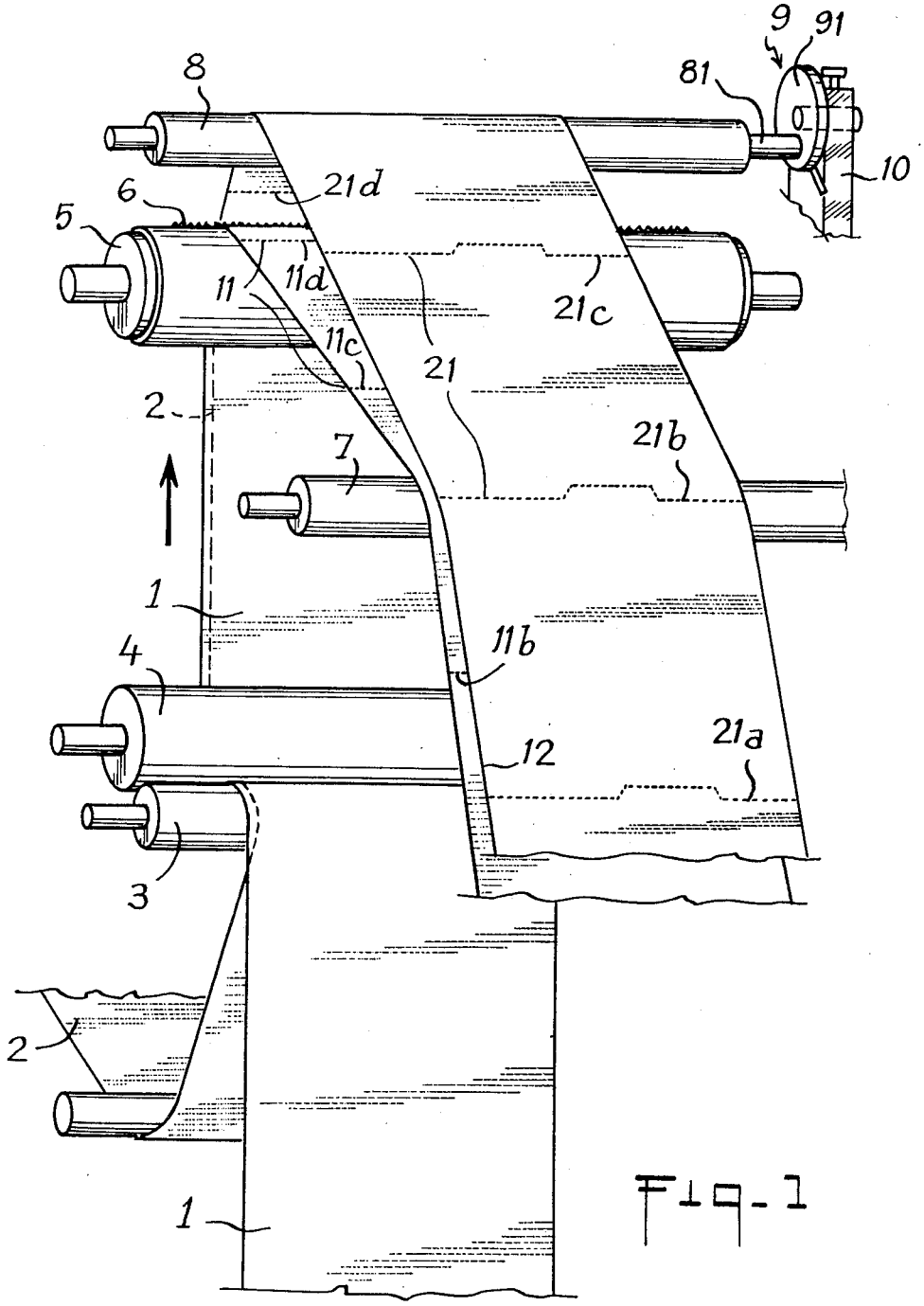
FIG. 1 is a view in perspective of an apparatus showing the relative shift and superposition of two strips according to the invention.

Referring now to the drawings, FIG. 1 shows an installation in which two strips 1 and 2 of paper or the like are superposed and driven together by two drive rollers 3, 4. The strips 1 and 2 are conducted as far as a roller 5 provided with a perforating device 6. One of the strips, strip 1 for example, is conducted directly to a following roller 7. On the contrary, the strip 2 follows a different path and is conducted to roller 8. The strip 2, separated from strip 1, thus follows a longer path and undergoes a delay, before returning to superposition with respect to strip 1 at roller 7.

The strips of paper 1, 2 are perforated simultaneously at perforator 6, whilst they are in superposition with respect to each other. The perforations 11, 21 made on the strips 1 and 2 respectively constitute transverse perforation systems which weaken the paper and allow a subsequent tearing off by increasing the tension to which the strip is subjected. The different systems of transverse perforations are formed at regular intervals, at a distance L from one another as the strips 1 and 2 advance.

The position of the roller 8, which allows a separation of the strips 1 and 2, is adjustable in height by means of a system 9, for example with an eccentric, mounted on the frame 10 supporting the machine.

The system 9 may comprise, as shown in FIG. 1, an adjusting member employing an eccentric. It is also possible to make a first rough adjustment by a movable arm then to make a fine adjustment with the aid of an eccentric. A device 9 is disposed at each end of the shaft of the roller 8 so that the roller 8 always moves parallel to rollers 6 and 7. An adjustment may also be made by acting on the position of the downstream roller 7, or of the roller 6 itself.

As may be seen in FIG. 1, the transverse perforations 11*a*, 11*b*, 11*c*, 11*d*, made successively on the strip 1, are, at roller 7, offset with respect to the transverse perforations 21*a*, 21*b*, 21*c*, 21*d*, made simultaneously on the strip 2, by the perforator 6. The position of the roller 8 is adjusted by the adjusting device 9 so that the perforations 21 of the delayed strip 2 are offset rearwardly by a constant distance and more precisely by the distance L/n with respect to the perforations 11 of the non-delayed strip 1. As shown in FIG. 2, it is advantageous, in certain cases, to shift the strips 1 and 2 with respect to each other in the transverse direction, by a distance d, before reaching the perforator device 6, when it is desired to make bags.

The example shown in the Figures uses two strips 1 and 2. It would of course be possible to use a larger number of strips, for example three strips. In this case, two perforated strips should be offset, for example each with the aid of a roller such as 8 whose height is adjustable by an adjusting device such as 9, then again superposed on the third strip at the roller 7. In this case, it is desirable that the shift between the transverse perforations of one strip and the transverse perforations of an adjacent strip be L/3. More generally, with n strips, a longitudinal shift equal to L/n should be made between one strip and the following, L being the distance of a section of strip between two rows of transverse perforations. According to a variant, the perforated strips to be superposed may come from superposed reels, adjustable in height, acting as rollers 8 and may be connected downstream at a common roller, such as roller 7. Therefore, it is not indispensable that the strips all be perforated simultaneously, although this facilitates manufacture.

Each of the perforated strips to be superposed with shift may of course be subjected, individually or not, after or before perforation, to various conventional treatments such as printing, corrugating, etc.

According to a first application of the method of the invention, the superposed, longitudinally offset, perforated strips 1, 2 are wound again, downstream of roller 7, to form rolls such as rolls of toilet paper, household paper, paper towels, baby's cellulose diapers, etc. For the same thickness of roll, the speed of winding on the same shaft is doubled or tripled, if two or three superposed strips are used. Furthermore, utilisation remains simple since, due to the shift of the perforations of the strips will respect to one another, it is possible easily to detach a section of strip from each of the strips successively, without risk of simultaneously detaching two sections of strip, as would happen if the superposed strips were not shifted longitudinally with respect to one another.

In the case of the manufacture of sheets from longitudinally offset, perforated strips, the division into sections which is effected mechanically downstream of the roller 7 with the aid of section tear-off devices by increasing the tension on the strip, may be effected with an increased yield without increasing the speed of advance of the strip or speed of rotation of the tear-off devices. An example of a device applicable for tearing off sections of strip will be described within the scope of the application relative to the manufacture of paper bags.

The method according to the invention is particularly useful within the scope of the manufacture of paper bags or sachets.

For manufacturing paper bags, the procedure is conventional, in that the longitudinal edges 12, 13 of a strip 1 provided with transverse perforations 11 equidistant from one another, are folded and the ajacent longitudinal parts of the longitudinal edges 12, 13 which overlap each other are glued so as to form a tube which is then divided into sections by tearing at the transverse perforations of the strip folded into a tube. When the strip is folded, it is possible to form expanding sides in manner known per se. Within the scope of the conventional bag manufacturing methods, it is, however, only envisaged to form individual tubes, which tubes may possibly be located on two treatment chains located side by side. In any case, the production capacity of a machine is reduced or the dimensions of the installation are large.

According to the invention, the superposed, longitudinally and transversely offset strips 1, 2 (FIG. 2) may be folded in one operation on a conventional single-strip machine, with or without the formation of expanding sides 15, 25, so as to lead to the formation of a double tube (or triple tube in the case of three strips, quadruple in the case of four strips, etc.). The two tubes 16, 26 formed are fitted in each other, and the overlapping zones of the strips 1 and 2 adjacent the longitudinal edges 12, 13 and 22, 23 respectively are glued with the aid of strips or dots of glue 14, 24 respectively. The overlapping zones or seams of the strips 1 and 2 on which the longitudinal strips of glue 14, 24 are disposed, may be relatively reduced, of the order of 15 to 25 mm. To glue together the different tubes, it suffices to have a gluing element (gluing disc or nozzle) per superposed strip of paper. The different folded strips 1, 2 intended to form tubes 16, 26 are glued simply with gluing elements transversely offset with respect to the superposed strips, insofar as the strips 1, 2 are themselves slightly shifted transversely by a short distance d (FIG. 2). The strips 1, 2 are generally given a transverse shift d as soon as they are unwound, and before perforation. FIG. 3 shows, in section, a double tube 16, 26 formed from the strips 1, 2 of FIG. 2. The zones 14, 24 provided with glue are slightly offset due to the transverse shift of the strips 1, 2, which precisely corresponds approximately to the width of a "seam."

Figure 4:
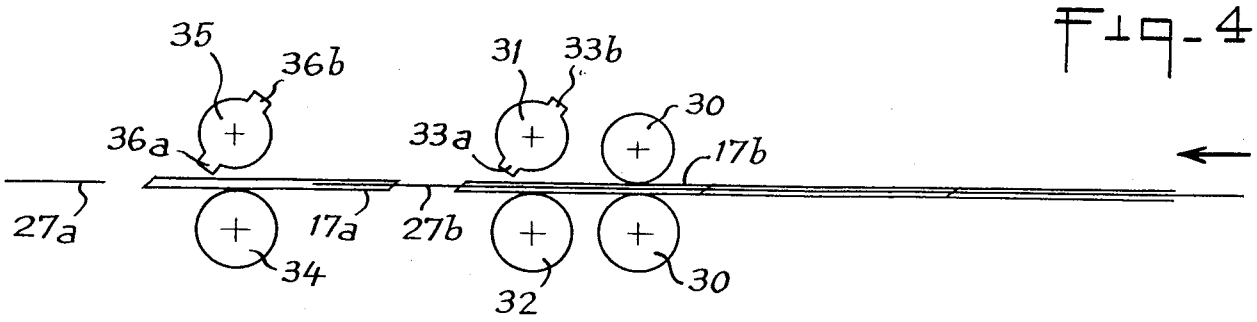
FIG. 4 is a view in elevation of an apparatus for separating into sections, according to the invention.
Figure 5:
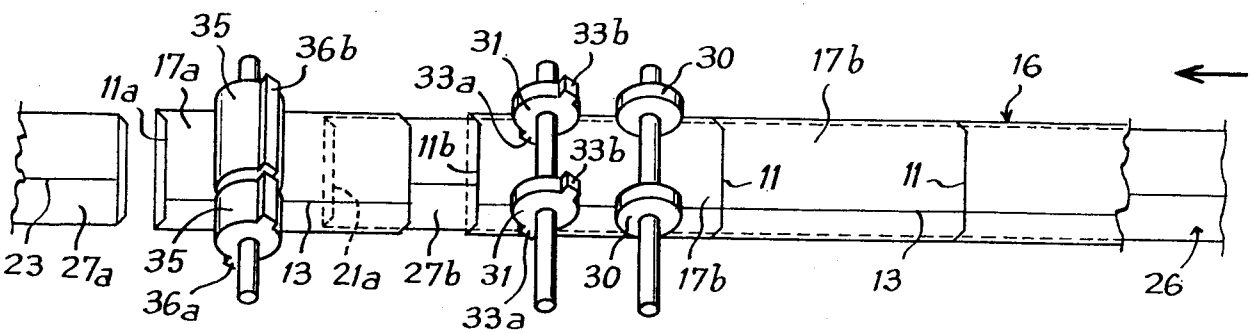
FIG. 5 is a perspective view of the apparatus of FIG. 4.

FIGS. 4 and 5 show an apparatus for dividing a set of superposed tubes 16, 26 such as the tubes of FIG. 3, into sections. The apparatus of FIGS. 4 and 5 is also applicable to the division into sections of single superposed, longitudinally offset strips, with or without transverse shift, like the strips 1, 2 of FIGS. 1 and 2.

As may be seen in FIGS. 4 and 5, the concentric tubes 16, 26 formed, arrive simultaneously at the press and drive rollers 30 following which are disposed pairs of rollers 31, 32, at least one of which is provided with cams or sectors **33*a*, 33*b* regularly distributed on the periphery of the corresponding roller 31. In FIGS. 4 and 5, which correspond to an embodiment with two concentric tubes, the sectors 33*a*, 33*b* are two in number and are disposed at 180° with respect to each other. In the case of three superposed strips or three concentric tubes, the sectors of rollers 33** would be three in number and offset by 120° with respect to one another.

The sectors **33*a*, 33*b* come successively into engagement with the tubes 16, 26 which advance after having passed between rollers 30. The sectors 33*a*, 33*b* of the rollers 31 retain the tubes 16, 26 for a short instant, whilst pairs of rollers 34, 35 similar to the pairs of rollers 32, 31 and disposed downstream with respect thereto at a distance close to the length L of a section 17, 27 of the tube 16, 26, exert on the last section of tube which is most downstream a pulling effort which leads to said section of tube being torn off, at the perforations limiting said section upstream of the rollers 34, 35. In fact, the movement of rotation of the rollers 31 is synchronised with the advance of the strip, and the sectors 33*a*, 33*b* respectively retain the different concentric tubes immediately upstream of a row of perforations of the section of tube which is the most downstream, whilst the sectors 36*a*, 36*b* respectively impart to said last section of tube immediately upstream of its free terminal part, a traction causing said section to be detached, since the speed of rotation of the roller 35 is greater than that of the roller 31 and is, for example, double that of the roller 31**.

FIGS. 4 and 5 show a section **27*a* of the tube 26 which has already been detached, a section 17*a* of tube 16 which is in the process of being detached and sections 27*b* and 17*b* of the tubes 26 and 16 which are still joined together. The sectors 36*a* of the rollers 35 drive the section 17*a* of the tube 16, whilst the sectors 33*a* of the rollers 31 retain both the section 17*b* located immediately upstream of the section 17*a*, and the section 27*b* which presents a free end 21*a*. The section 17*a* is thus detached by tearing at the perforations 11*b*. The sectors 36*b* then come into engagement with the most downstream section 27*b* whilst the sectors 33*b* retain both the section 27*b* adjacent said most downstream section 27*b*, and the most downstream section 17*b*. Consequently, a section 17 or 27 is detached upon each half-revolution of the roller 31, alternately on the tube 16 and the tube 26. It is obvious that with three concentric tubes, for example, a section would be detached alternately on each tube, i.e. for a third of a revolution of rollers 31**.

The above-described process would be applicable in the same way for detaching superposed, longitudinally offset, perforated strip sections, in order to form sheets.

It follows from the above that the production rates of sheets or sections of tube intended to form sachets can be increased without modifying the speeds of advance movement of the strips or the speeds of rotation of the drive or tear-off rollers.

Furthermore, the device according to the invention may easily be adapted to existing single-strip machines. In fact, to work with a plurality of superposed, offsettable strips, it suffices to add a roller 8 with adjustment means 9, per supplementary strip, possibly a supplementary gluing member per supplementary strip in the case of formation of tubes, and it suffices to provide the rollers 31, 35 with a number of sectors 33, 36 respectively, which is equal to the total number of strips, said sectors 33, 36 being regularly distributed on the periphery of the rollers 31, 35 respectively. The system of adjustment may be very simple. As shown for example in FIG. 1, the shaft 81 of the roller 8 may be simply mounted to rotate freely in a hole made eccentrically in a disc 91 which may be rotated manually. By adjusting the position of the disc 91, the position in height of the shaft 81 and thus of the roller 8 is simply adjusted with respect to rollers 6 and 7, so that the supplementary path of a delayed strip 2 may be adjusted so that the rows of perforations 21 are positioned very precisely with respect to the perforations 11. The disc 91 may naturally be blocked in the desired position with the aid for example of a lock screw.

By the possibility offered by the invention of effecting, successively and independently, tear-off operations on each of the treated strips, from the same rollers or tear-off members, said invention enables the yield to be increased, whilst previously ensuring a mechanical reinforcement of the superposed strips which advance in a treatment machine, since the perforations of the different strips are offset with respect to one another. Furthermore, it is possible, in the same treatment chain, to produce articles of identical dimensions, but of a different appearance (colour, different print, corrugated or not, . . . ) as each of the superposed strips may, particularly before perforation, be treated independently from the other strips. This increases the variety of the products obtained.

It will further be noted that, in the case of manufacturing bags from a plurality of tubes fitted in one another, each section of tube torn off is guided partially by the other outer or inner tubes, this facilitating transfer to the following treatment station. This guiding also enables the noise caused by the tear at the perforations to be reduced.

The invention is not to be understood as restricted to the details set forth since these may be modified within the scope of the appended claims, without departing from the spirit and scope of the invention.

What is claimed is:

1. A method for manufacturing articles made of paper, tissue paper, cellulosic matter, plastic or the like from n strips wherein n represents the number of strips and is an integer equal to or greater than two, said method comprising the steps of, forming transverse perforations at regular intervals in each strip to define in each strip a plurality of elementary sections having the same length L, superimposing said perforated strips such that each perforated strip is offset, in the longitudinal direction, with respect to an adjacent strip, by a distance equal to L/n, and thereafter, exerting successively and independently on each of the successively superimposed strips a pulling and tear-off action to divide the longitudinally offset, superimposed perforated strips into separate elementary sections.

2. The method of claim 1, wherein said step of forming transverse perforations comprises the steps of first superimposing unperforated strips and then perforating the strips simultaneously; and said step of superimposing the perforated strips comprises the steps of separating the perforated strips after the perforating step and thereafter superimposing again the various perforated, separated strips by effecting a shift, in the longitudinal direction, by a distance equal to L/n between two adjacent perforated strips.

3. The method of claim 1, wherein said step of forming transverse perforations comprises the step of perforating the different strips independently from one another, and said step of superimposing the perforated strips comprises superimposing the various already perforated strips by effecting a shift, in the longitudinal direction, by a distance equal to L/n between two adjacent perforated strips.

4. The method of claim 1 including the further step of offsetting each strip with respect to an adjacent strip in the transverse direction, by a short distance before longitudinally offsetting and superimposing the various strips.

5. The method of claim 4, wherein the shift, in the transverse direction, of a strip with respect to an adjacent strip is at least equal to about 2 cm.

6. The method of claim 4, including, after said superimposing step, the further steps of folding and then gluing the longitudinal edges of each strip on each other to form tubes fitted in one another, and wherein said step of exerting successively and independently on each of the successively superimposed strips a pulling and tear-off action comprises the step of exerting, momentarily, a pulling action in the vicinity of the free end of the tube which is each time the most downstream, to provoke a tear-off at the perforations nearest the free end of the tube on which the pulling action is exerted to thereby divide the tubes fitting in one another into separate single-ply sections of tube.

7. An apparatus for manufacturing articles made of paper, tissue paper, cellulosic matter, plastic or the like from n strips wherein n represents the number of strips and is an integer equal to or greater than two, comprising perforating means for making a row of transverse perforations in said n strips, n rollers equal to the number n of strips, said rollers being mounted offset in height with respect to one another but parallel to one another downstream of the perforating means for effecting a longitudinal shift of the perforated strips with respect to one another, a supplementary common roller disposed downstream of said n rollers to receive, in superimposed position, the different strips issuing from the n rollers offset in height, and separating means disposed downstream of said supplementary common roller for exerting a supplementary pull and effecting a tear-off of sections defined between two successive rows of transverse perforations, by successive action on each of the superimposed strips.

8. The apparatus of claim 7, including means for adjusting the offset of at least one of said n rollers offset in height.

9. The apparatus of claim 7, wherein said separating means comprise a first group of pairs of stop rollers, one of which has stop cams thereon, and a second group of pairs of tear-off rollers, one of which has tear-off cams thereon, the tear-off rollers being disposed downstream of the stop rollers, parallel thereto and at a distance of the order of the length of a section of strip or tube, and the stop and tear-off cams being in a number equal to the number of n strips and regularly distributed over the periphery of their corresponding rollers.

* * * * *